United States Patent [19]

Podlesny et al.

[11] Patent Number: 4,896,131

[45] Date of Patent: Jan. 23, 1990

[54] STUD FINDER WITH ONE-PIECE MAGNET ASSEMBLY

[75] Inventors: Daniel B. Podlesny, New Brunswick; Ralph Lopez, Cliffwood Beach, both of N.J.

[73] Assignee: Red Devil, Inc., Union, N.J.

[21] Appl. No.: 335,748

[22] Filed: Apr. 10, 1989

[51] Int. Cl.[4] ..... H01F 7/02

[52] U.S. Cl. ..... 335/302; 335/303

[58] Field of Search ..... 335/285, 302, 303, 306

[56] References Cited

U.S. PATENT DOCUMENTS 2,933,679 4/1960 Bray ..... 335/302

4,702,852 10/1987 Sakauchi et al. ..... 335/303 X 4,810,572 3/1989 Ooe et al. ..... 335/303 X

*Primary Examiner*—George Harris

*Attorney, Agent, or Firm*—Lane & Aitken

[57] ABSTRACT

A Stud Finder includes a one-piece magnet assembly molded from a moldable plastic material containing a dopant capable of being permanently magnetized along a desired axis. The one-piece magnet assembly includes integral pivot bosses for pivotably supporting the magnet assembly in a location where it can be influenced by the nearby presence of magnetic metals such as steel nails. The plastic material is capable of accepting integral coloring.

4 Claims, 4 Drawing Sheets

STUD FINDER WITH ONE-PIECE MAGNET ASSEMBLY

BACKGROUND OF THE INVENTION

The present invention relates to hand tools and, more particularly, to hand tools useful in carpentry. Even more particularly, the present invention relates to stud finders for locating magnetic fastening devices retaining building studs in place.

One of the problems faced by a person attempting to perform renovation of an existing structure is discerning the hidden elements of the structure. For example, when it is desired to affix something to a wall, it is frequently desirable to drive a screw or a nail into a wooden stud which forms the main structural supporting member of the wall. In most conventional construction, however, the locations of studs is hidden by overlying layers of, for example, plaster, sheetrock, wallpaper or paneling.

For many years, it has been conventional to locate studs based on the knowledge that studs are conventionally installed using steel nails. The locations of the steel nails are determined magnetically, and the locations of the studs are inferred from the nail locations.

One of the simplest magnetic devices, sold under the trademark Stud Finder, by Red Devil, Inc. of Union N.J., employs a magnet assembly containing a small bar magnet pivoted within a plastic housing. When the magnet assembly is brought within about one-half inch (1.23 centimeters) of a steel nail, one of the magnetic poles of the bar magnet is attracted to the steel in the nail, thereby rotating the magnet assembly. The Stud Finder is then moved until the magnet assembly is aligned at right angles to the wall. This marks the location of one nail, and of the stud into which it is drive. Once one stud is located, conventional regularity in spacing of studs, at 24 or 48 inches apart (corresponding to one-half, or the full width of a conventional four-foot panel), reduces the difficulty of finding other studs.

A conventional Stud Finder includes a metallic bar magnet enclosed within a two-piece plastic jacket. The plastic jacket is convenient, since each half includes a protuberance useful for pivoting within the housing. The plastic jacket is further useful since it can be given a suitable color.

It will be recognized by those skilled in the art that a three-piece magnet assembly (metallic bar magnet and two halves of the plastic jacket) add to the manufacturing and assembly time and cost. An alternative technique to reduce the manufacturing and assembly time and cost appears to be desirable.

OBJECTS AND SUMMARY OF THE INVENTION

It is an object of the invention to provide a Stud Finder which overcomes the drawbacks of the prior art.

It is a further object of the invention to provide a Stud Finder having a one-piece magnet assembly.

It is a still further object of the invention to provide a one-piece magnet assembly for a Stud Finder.

Briefly stated, the present invention provides a Stud Finder having a one-piece magnet assembly molded from a moldable plastic material containing a dopant capable of being permanently magnetized along a desired axis. The one-piece magnet assembly includes integral pivot bosses for pivotably supporting the magnet assembly in a location where it can be rotated by the nearby presence of magnetic metals, such as steel nails. The plastic material is capable of accepting integral coloring.

According to an embodiment of the invention, there is provided a magnetic detection device comprising: a housing, a magnet assembly pivotable in the housing, the magnet assembly including a one-piece molded body, the one-piece molded body including first and second integrally molded pivot bosses at opposed sides of the one-piece molded body and centrally disposed along a length thereof, and the magnet assembly being capable of being magnetized along a desired axis.

According to a feature of the invention, there is provided a magnet assembly for a magnetic detection device comprising: a one-piece molded body, the one-piece molded body including first and second integrally molded pivot bosses at opposed sides of the one-piece molded body and centrally disposed along a length thereof, and the magnet assembly being capable of being magnetized along a desired axis thereof.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
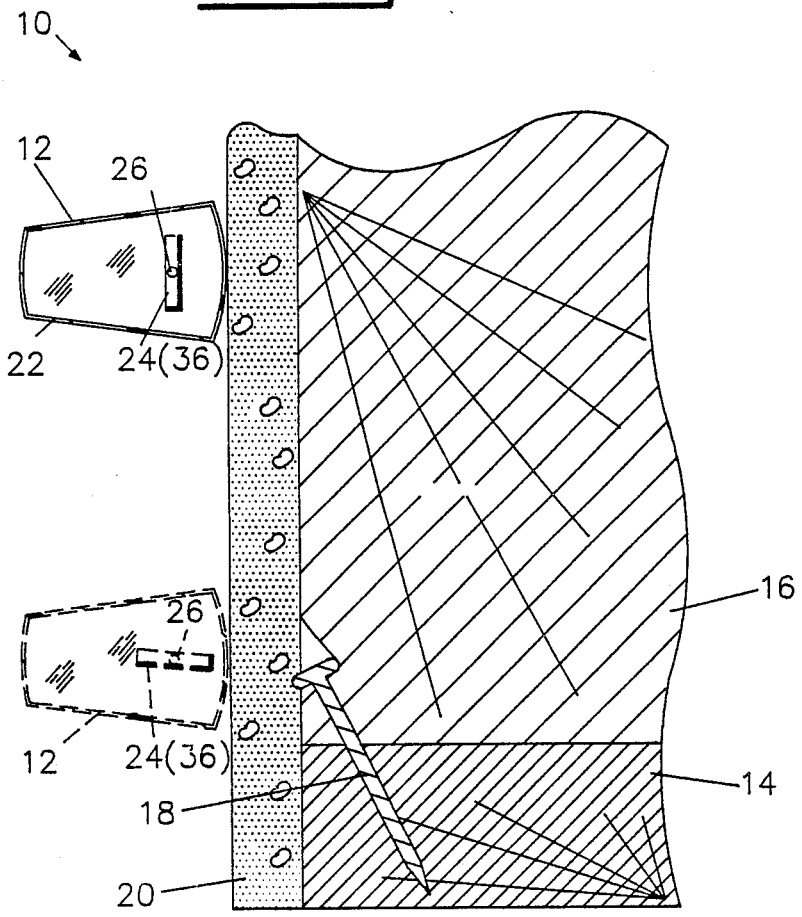
FIG. 1 is a cross section of a wall showing the manner in which a Stud Finder locates a stud.

Referring first to FIG. 1, there is shown, a wall 10 of conventional construction with which a Stud Finder 12 may be used. Wall 10 is built upon a bottom plate 14 affixed upon a floor (not shown). A vertical stud 16 is affixed to bottom plate 14 using one or more steel nails 18 angled, or toed, through stud 16, and into bottom plate 14. One skilled in the art will recognize that an upper end (not shown) of stud 16 is affixed in a similar way to secure stud 16 at both ends and, optionally, at one or more intermediate locations. Bottom plate 14 and stud 16 are conventionally covered by a plaster coating 20, or other wall covering, thereby concealing the locations of studs 16 and steel nails 18.

Stud Finder 12 includes a housing 22 (the upper, or closer, half of which is removed to reveal internal components) and a magnet assembly 24. A pivot boss 26 is formed in an outer surface centered at each side of magnet assembly 24 to provide pivoting support therefor.

When out of the magnetic influence of steel nail 18, as shown in solid line, magnet assembly 24 is rotated to a random angle which remains substantially constant as Stud Finder 12 is moved about. When Stud Finder 12 is moved into close enough proximity to steel nail 18, as shown in dashed line, magnet assembly 24 is rotated about pivot boss 26 until its longitudinal axis points toward steel nail 18. Acquisition of a steel nail 18 is verified by moving Stud Finder 12 past steel nail 18, and noting that magnet assembly 24 rotates to maintain its axis pointing toward a substantially stationary point.

Although FIG. 1 illustrates Stud Finder 12 being moved in a vertical direction, a convenient strategy for finding studs 16 includes moving Stud Finder 12 in a horizontal direction on, or a short distance above, a floor upon which bottom plate 14 is installed. Other strategies may be devised by those skilled in the art for finding the upper ends of studs 16 or horizontal fire breaks (not shown) intermediate the ends.

Some construction employs galvanized steel studs supporting sheetrock wall panels. Such galvanized steel studs are easily located with Stud Finder 12.

Figure 2:
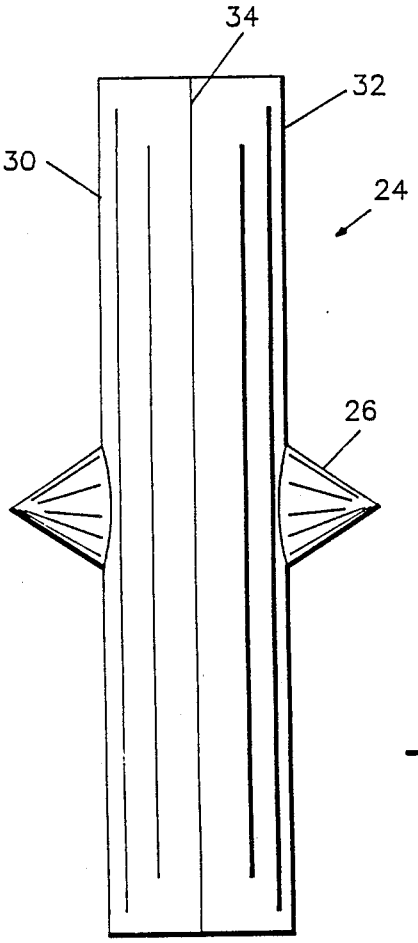
PRIOR ART Fig. 2
FIG. 2 is an enlarged view of the magnet assembly of FIG. 1.
Figure 3:
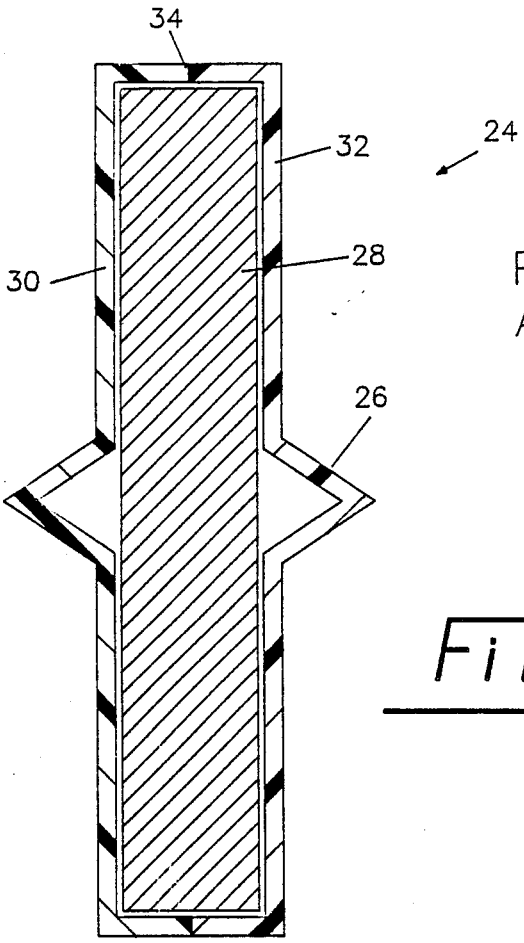
PRIOR ART Fig. 3
FIG. 3 is a longitudinal cross section of the magnet assembly of FIG. 2.

Referring now to FIGS. 2 and 3, magnet assembly 24 consists of a bar magnet 28, preferably cylindrical, encased within first and second molded plastic halves 30 and 32. Molded plastic halves 30 and 32 are joined together at a mating line 34 to secure magnet assembly 24 together. Each of molded plastic halves 30 and 32 contains its respective pivot boss 26 centrally disposed thereon. Pivot bosses 26 are seen to be conical for ease of assembly and avoidance of critical clearance and fit problems when assembled into housing 22.

As will be clear to one skilled in the art, the manufacture and assembly of a three-part magnet assembly 24 represents a substantial cost element in Stud Finder 12.

A new magnetic material has appeared which is capable of simplifying the construction of magnet assembly 24. More specifically, a moldable plastic material, capable of being magnetized along a desired axis is commercially available. This plastic material, sold commercially by the Dyanacast Division of Coates and Clark, Inc., consists of a moldable Nylon resin containing a magnetizable dopant such as, for example strontium ferrite. The moldable plastic material, being commercially available as of the time of filing of the present application requires no additional description herein. In addition, the manner in which the plastic material is injected into molds controls, to a degree, the direction in which a magnetic polar axis can be formed. This information is also well known in the art, and need not be repeated herein.

Figure 4:
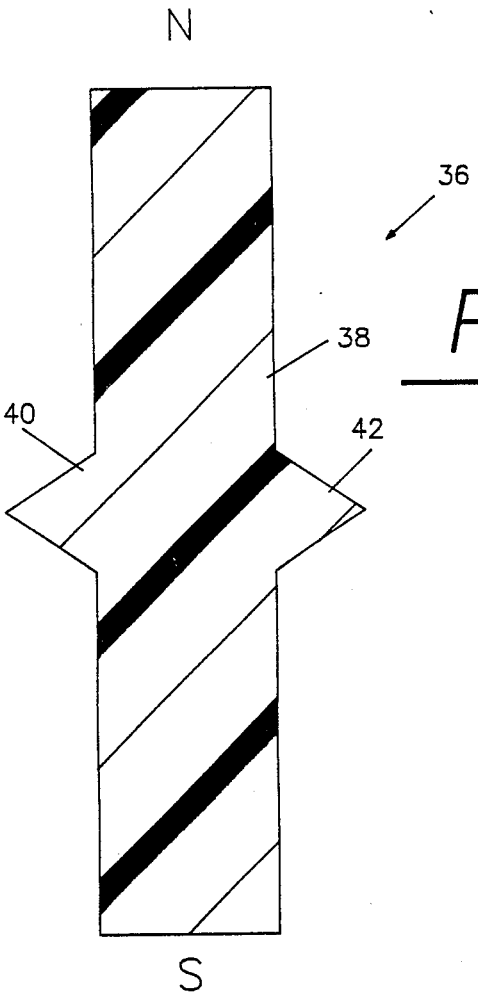
FIG. 4 is a longitudinal cross section of a magnet assembly according to an embodiment of the invention.

Referring now to FIG. 4, a one-piece molded magnet assembly 36, according to an embodiment of the invention, is shown. In contrast to the prior-art embodiment shown in FIGS. 2 and 3, one-piece molded magnet assembly 36 includes a one-piece body 38 having opposed conical pivot bosses 40 and 42 extending centrally therefrom. After molding, one-piece molded magnet assembly 36 is magnetized to place North and South magnetic poles at opposed ends of one-piece body 38.

The moldable nature of the material from which one-piece molded magnet assembly 36 is made avoids the need for multiple parts. In addition, all of the advantages of the prior-art three-piece assembly are retained. That is, conical pivot bosses 40 and 42 are functionally identical to pivot bosses 26 (FIGS. 2 and 3). Thus, one-piece molded magnet assembly 36 can be installed in the identical housing 22 (FIG. 1) of the prior-art device. Consequently a Stud Finder 12 can be assembled using one-piece molded magnet assembly 36 without the need for retooling parts of housing 22. In addition, since one-piece molded magnet assembly 36 is made of a moldable plastic, the desirable ability to contain an integral color in the plastic material is retained.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A magnetic detection device comprising:

a housing;

a magnet assembly pivotable in said housing;

said magnet assembly including a one-piece molded body;

said one-piece molded body including first and second integrally molded pivot bosses at opposed sides of said one-piece molded body and centrally disposed along a length thereof; and said magnet assembly being capable of being magnetized along a desired axis.

2. A magnetic detection device according to claim 1, wherein said desired axis includes a longitudinal axis of said one-piece body.

3. A magnetic detection device according to claim 1, wherein said one-piece molded body is capable of accepting a colorant material therein.

4. A magnet assembly for a magnetic detection device comprising:

a one-piece molded body;

said one-piece molded body including first and second integrally molded pivot bosses at opposed sides of said one-piece molded body and centrally disposed along a length thereof; and said magnet assembly being capable of being magnetized along a desired axis thereof.

* * * * *